US005555066A

United States Patent [19]

Benker

[11] Patent Number: 5,555,066

[45] Date of Patent: Sep. 10, 1996

[54] METHOD OF AND APPARATUS FOR REMOVING EXPOSED FILM FROM CARTRIDGES

[75] Inventor: Gerhard Benker, Icking, Germany

[73] Assignee: AGFA-Gevaert AG - Fototechnik, München, Germany

[21] Appl. No.: 461,576

[22] Filed: Jun. 2, 1995

[30] Foreign Application Priority Data

Jun. 14, 1994 [DE] Germany ..... 44 20 659.3

[51] Int. Cl.[6] ..... G03D 3/08

[52] U.S. Cl. ..... 354/319; 354/321; 354/340

[58] Field of Search ..... 354/310, 313, 354/319–324, 331, 336, 337, 339; 355/27–29, 72, 75; 226/92, 172, 173, 196, 199, 189, 91, 97; 242/562.1

[56] References Cited

U.S. PATENT DOCUMENTS

| | | | |
|---|---|---|---|
| 4,362,376 | 12/1982 | Otani | 354/319 |
| 4,843,430 | 6/1989 | Huber et al. | 354/313 X |
| 5,049,915 | 9/1991 | Nakamura et al. | 354/339 |
| 5,053,805 | 10/1991 | Sakai et al. | 355/27 |
| 5,308,005 | 5/1994 | Hutteman et al. | 226/92 |

FOREIGN PATENT DOCUMENTS

| | | |
|---|---|---|
| 242817A1 | 10/1987 | European Pat. Off. . |
| 2545214B2 | 5/1979 | Germany . |
| 3737788A1 | 5/1989 | Germany . |
| 4126579C1 | 8/1992 | Germany . |
| 4311483A1 | 10/1993 | Germany . |
| 62-286052 | 11/1987 | Japan . |

*Primary Examiner*—D. Rutledge
*Attorney, Agent, or Firm*—Darby & Darby, P.C.

[57] ABSTRACT

An apparatus for developing films confined in cartridges has a lightproof housing which accommodates a developing bath. Two chambers are located in the housing upstream of the developing bath, and each has a holder for a film cartridge. Transporting rollers are associated with each chamber and serve to withdraw films from cartridges and convey the films toward the developing bath along respective paths. These paths merge into a third path which extends through the developing bath. A first film cartridge is placed in a first one of the chambers, and the chamber is closed with a cover to seal the chamber from light. A control unit locks the cover and activates the transporting rollers for the first chamber so that the film in the first cartridge is unwound and conveyed into the developing bath. Meanwhile, a second film cartridge is placed in the second chamber which is likewise closed with a cover. A sensor signals the control unit when the withdrawal of film from the first cartridge has been completed. The control unit then unlocks the cover and stops the transporting rollers for the first chamber while locking the cover and starting the transporting rollers for the second chamber. The film from the second cartridge is thereupon conveyed into the developing bath closely behind the film from the first cartridge.

27 Claims, 2 Drawing Sheets

METHOD OF AND APPARATUS FOR REMOVING EXPOSED FILM FROM CARTRIDGES

BACKGROUND OF THE INVENTION

The invention relates to the treatment of image-recording media, particularly photographic film.

The German patent 41 26 579 discloses a continuous film developing apparatus having an arrangement for withdrawing exposed photographic film from cartridges. A cartridge is placed in a lightproof chamber and the film is withdrawn from the cartridge by a conveying device. Only one film cartridge can be placed in the developing apparatus at one time, and an operator must always be present when a film has been pulled into the apparatus completely. Only then can the lightproof chamber be opened to remove the empty cartridge, insert a new cartridge and feed the leading end of the film into the conveying device. On the one hand, this requires the operator to be present for much of the time and also requires a high degree of concentration. On the other hand, the replacement of an empty cartridge by a full cartridge results in a loss of time which significantly affects the output of the developing apparatus.

To alleviate these drawbacks, the German publication 43, 11, 483 teaches a magazine which can receive film cartridges and has a device for guiding films into the developing apparatus. With this arrangement, there is a fixed number of supply stations which are successively brought into a processing station. The arrangement is not only very costly but gaps develop when cartridges are not placed in the supply stations continuously. Such gaps result in lost processing time. If the gaps are to be avoided, complicated devices must be provided. Moreover, from the moment that films are placed in the supply stations, the processing sequence for the films is fixed and priority treatment of urgent films is not possible.

SUMMARY OF THE INVENTION

It is an object of the invention to provide an apparatus which makes it possible to reduce the cost of processing image-recording media confined in containers.

Another object of the invention is to provide an apparatus which enables one container of image-recording medium after another to be placed therein such that little processing capacity remains unused.

An additional object Of the invention is to provide a method which can achieve a reduction in the cost of processing image-recording media confined in containers.

A further object of the invention is to provide a method which allows virtually full processing capacity to be realized when feeding containers of image-recording media in succession.

The preceding objects, as well as others which will become apparent as the description proceeds, are achieved by the invention.

One aspect of the invention resides in an apparatus for processing image-recording media confined in substantially lightproof containers. The apparatus comprises first wall means defining a first substantially lightproof chamber for unloading the containers, and second wall means defining a second substantially lightproof chamber for unloading the containers. The apparatus further comprises first conveying means for conveying image-recording media from the first chamber along a first path having an upstream portion in the first chamber, and second conveying means for conveying image-recording media from the second chamber along a second path having an upstream portion in the second chamber. The first and second paths have a junction, and merge into a third path, downstream of the chambers.

The apparatus of the invention thus has a plurality of, and preferably two, unloading chambers. A conveying means is associated with each chamber, and the conveying means are arranged to convey image-recording media from the different chambers along respective paths which merge into a third path, e.g., like switch tracks. Containers to be unloaded can be placed in the two chambers alternately and, after the image-recording medium in one chamber has been unloaded and conveyed into the third path, the image-recording medium from the other chamber can be fed into the third path virtually contiguous to the preceding image-recording medium. The time available for an operator to place a loaded container in a chamber is accordingly relatively long and equals the time required to unload an image-recording medium from a container in the second chamber. This can be achieved at a relatively modest cost since the unloading chambers can be largely identical and require little in the way of mechanical expenditures. Moreover, the containers can be placed in the unloading chambers in any desired sequence so that priority handling is possible.

Another aspect of the invention resides in a method of processing image-recording media confined in substantially lightproof containers. The method comprises the steps of placing a first container with a first image-recording medium in a first chamber, withdrawing the first image-recording medium from the first container, conveying the first image-recording medium out of the first chamber along a first path, and transferring the first image-recording medium from the first path into an additional path at a predetermined location. The method further comprises the steps of placing a second container with a second image-recording medium in a second chamber, withdrawing the second image-recording medium from the second container, conveying the second image-recording medium out of the second chamber along a second path, and transferring the second image-recording medium from the second path into the additional path at the predetermined location. The step of transferring the second image-recording medium is performed subsequent to the step of transferring the first image-recording medium and is preferably carried out in such a manner that the leading end of the second image-recording medium is adjacent the trailing end of the first image-recording medium.

The step of placing the second container in the second chamber may be performed concurrently with the step of withdrawing the first image-recording medium from the first container.

The method can additionally comprise the step of removing the first container from the first chamber subsequent to the step of withdrawing the first image-recording medium from the first chamber. The method may then comprise the steps of placing a third container with a third image-recording medium in the first chamber, withdrawing the third image-recording medium from the third container, conveying the third image-recording medium out of the first chamber along the first path, and transferring the third image-recording medium from the first path into the additional path at the predetermined location. The step of transferring the third image-recording medium is performed subsequent to the step of transferring the second image-recording medium.

The steps of removing the first container from, and placing the third container in, the first chamber are preferably performed concurrently with the step of withdrawing the second image-recording medium from the second container.

The steps of placing the containers in the first and second chambers may involve opening a first portion of the respective chamber while the steps of conveying the image-recording media out of the first and second chambers may involve opening a second portion of the respective chamber. The method may here comprise the further steps of preventing opening of the first portion of each chamber when the corresponding second portion is open, and keeping the second portion of each chamber closed when the corresponding first portion is open.

The steps of withdrawing an image-recording medium from a container and conveying the image-recording medium out of a chamber can be initiated upon opening of the second portion of the respective chamber.

The method may also comprise the steps of detecting the trailing ends of the image-recording media in the respective paths, generating a signal in response to detection of each trailing end, and regulating the second portion of each chamber, as well as the withdrawing and conveying steps for the respective chamber, using the respective signal.

In addition, the method can comprise sensing the tension of each image-recording medium during the respective withdrawing and conveying steps.

The method may further comprise severing the respective image-recording media in response to sensing of a predetermined tension therein.

Additional features and advantages of the invention will become apparent from the following detailed description of preferred embodiments when read in conjunction with the accompanying drawings.

DESCRIPTION OF THE PREFERRED EMBODIMENTS

Figure 1:
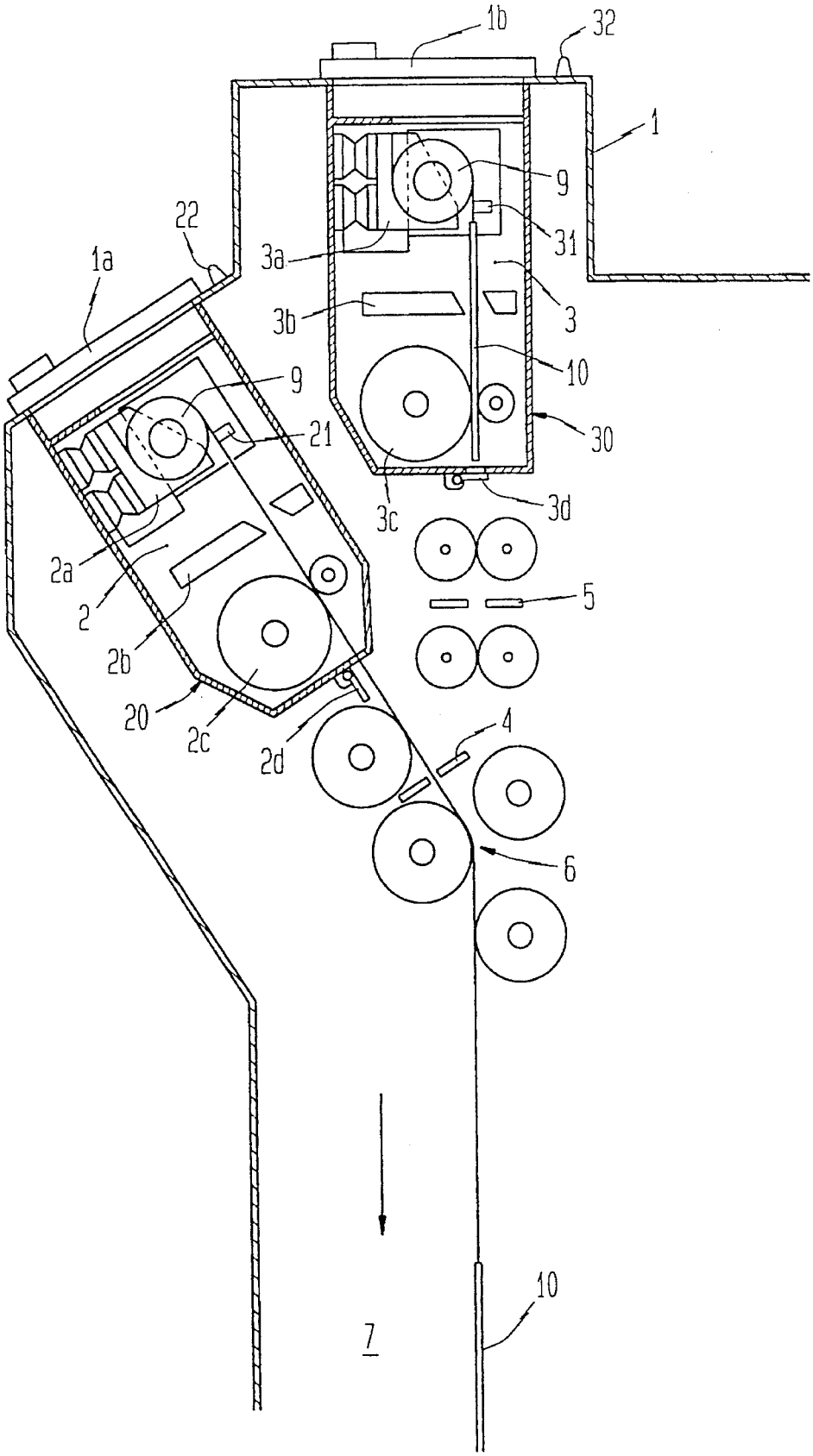
FIG. 1 schematically illustrates an apparatus according to the invention for processing image-recording media.

With reference to FIG. 1, the numeral 1 identifies a lightproof housing constituting part of an arrangement for processing flexible, elongated image-recording media confined in lightproof containers. The image-recording media are here photosensitive photographic films, that is, photographic films which have been exposed but not yet developed. The containers confining the films are conventional film cartridges 9 having slit-like openings through which the films may be withdrawn from the cartridges 9.

The processing arrangement includes an apparatus 7 for continuously developing film, and the housing 1 is mounted at the inlet of the developing apparatus 7. The developing apparatus 7 may constitute part of a unit which includes, in addition to the developing apparatus 7, an apparatus for copying photographic films on copying paper and another apparatus downstream of the copying apparatus for developing the copying paper. Such a structure is disclosed, for example, in the German publication 41 26 579. However, the invention is equally applicable whether the film developing apparatus 7 constitutes part of a unit or is freestanding.

The film developing apparatus 7 is not shown in detail. It can be conventional and may be provided with roller racks and lateral guides. If films of only one width are to be processed, e.g., 135 mm films, the lateral guides can be incorporated directly in the lateral plates of the racks.

Where films of different width are to be processed, it is particularly advantageous to attach the leading ends of the films to so-called leader cards 10. The lateral guides of the film developing apparatus 7 are then matched to the width of the leader cards.

The invention can be used regardless of whether the film developing apparatus 7 is designed for films of a single width or films of varying width. The film developing apparatus 7 is here assumed to be capable of processing films of different width using the leader cards 10 which are secured to the leading ends of the films.

The lightproof housing 1 has an inlet end for the introduction of the film cartridges 9 therein and the inlet end of the housing 1 is provided with an enlargement. A pair of lightproof chambers 2 and 3 are disposed within the enlargement and are designed to receive the film cartridges 9. The lightproof chambers 2, 3 serve for the unwinding or unloading of the film cartridges 9 placed therein.

The inlet end of the housing 1 has a horizontal wall, and the unwinding chamber 3 is located below this wall. The horizontal wall of the housing 1 is provided with an opening for insertion of film cartridges 9 in the chamber 3. The chamber 3 is defined by a set of walls 30, and a cover **1*b* for the opening in the horizontal wall of the housing 1. The cover 1*b*, which can be opened and closed manually but is provided with a solenoid-controlled locking mechanism, is designed to seal the chamber 3** from light.

The chamber 3 is provided with a holder or support **3*a* for a film cartridge 9. The holder 3*a* is designed to support a cartridge 9 in such a manner that the slit-like opening of the cartridge 9 faces downward. A conveying or transporting device 3*c* is located below the cartridge holder 3*a* and functions to withdraw a film from a cartridge 9 and to convey the film along an essentially straight, vertical path extending through the chamber 3 to the exterior thereof. The conveying device 3*c* consists of a driven roller, and a second roller which exerts a counterpressure against the driven roller. The driven roller can, for instance, be connected with a stepping motor which is regulated by a control system to be described below. The width of the conveying device 3*c* approximates or equals the width of the leader cards 10**.

A cutter or severing unit **3*b* is located between the cartridge holder 3*a* and the conveying device 3*c*. The cutter 3*b* defines a passage which is in register with the vertical path originating in the chamber 3**.

The cartridge holder **3*a* can be provided with a sensor 31 for sensing the tension in a film being withdrawn from a cartridge 9. The sensor 31 may be connected to the cutter 3*b*, and the arrangement may be such, for example, that the cutter 3*b* severs a film being withdrawn from a cartridge 9 when the tension in the film reaches a predetermined value. Thus, the tension in a film will increase noticeably when the trailing end of the film reaches the slit-like opening of its cartridge 9**.

The end of the chamber 3 remote from the cover **1*b* is provided with an outlet opening. The outlet opening, which is in the vertical path originating in the chamber 3, can be closed by a flap 3*d*** which is controlled by a solenoid.

Downstream of the unwinding chamber 3 are additional conveying or transporting rollers for a film unwound in the chamber 3. The number of additional conveying rollers is selected as necessary to insure proper transport of a film exiting the chamber 3.

Lateral guides for the leader cards 10 run along the essentially straight, vertical path originating in the chamber 3. The lateral guides extend to the film developing apparatus 7.

A sensor 5 for detecting the trailing end of a film exiting the chamber 3 is disposed at a predetermined distance downstream of the chamber 3. The sensor 5 can be in the form of an infrared light barrier.

The inlet end of the housing 1 has a second wall which is located at the front of the housing 1 and is inclined at an angle of about 30 degrees to the horizontal. Below the inclined wall, which can support a console, is the unwinding chamber 2. The unwinding chamber 2 is essentially identical to, and accommodates the same components as, the unwinding chamber 3. Thus, the unwinding chamber 2 contains a cartridge holder or support 2*a*, a cutter or severing unit 2b, and a conveying or transporting device 2*c*. The conveying device 2*c* is arranged to withdraw a film from a cartridge 9 and to convey the film along an inclined path extending through the chamber 2 to the exterior thereof. The conveying device 2*c* includes a driven roller, and the driven roller can, as before, be connected to a stepping motor which is regulated by a control system still to be described. The width of the conveying device 2*c* approximates or equals the width of the leader cards 10.

The cartridge holder 2*a* is again provided with a sensor 21 for sensing the tension in a film being withdrawn from a cartridge 9.

The inclined wall of the housing 1 is provided with an opening for insertion of film cartridges 9 in the chamber 2. The chamber 2 is defined by a set of walls 20, and a cover 1*a* for the opening in the inclined wall of the housing 1. The cover 1*a*, which can be opened and closed manually but is provided with a solenoid-controlled locking mechanism, is designed to seal the chamber 2 from light.

The end of the chamber 2 remote from the cover 1*a* is provided with an outlet opening. The outlet opening, which is in the inclined path originating in the chamber 2, can be closed by a flap 2*d* which is controlled by a solenoid.

Downstream of the unwinding chamber 2 are additional conveying or transporting rollers for a film unwound in the chamber 2. The number of additional conveying rollers is selected as necessary to insure proper transport of a film exiting the chamber 2.

A sensor 4 for detecting the trailing end of a film leaving the chamber 2 is disposed at a predetermined distance downstream of the chamber 2. Like the sensor 5, the sensor 4 can be in the form of an infrared light barrier.

Downstream of the sensors 4 and 5, the vertical path originating in the chamber 3 and the inclined path originating in the chamber 2 meet at a junction 6. The two paths merge into a third path at the junction 6, and the third path extends from the junction 6 into the film developing apparatus 7. Thus, the vertical path originating in the chamber 3 and the inclined path originating in the chamber 2 can be considered to merge in a manner resembling a switch track. The width of the junction 6 approximates or equals the width of the leader cards 10.

Figure 2:
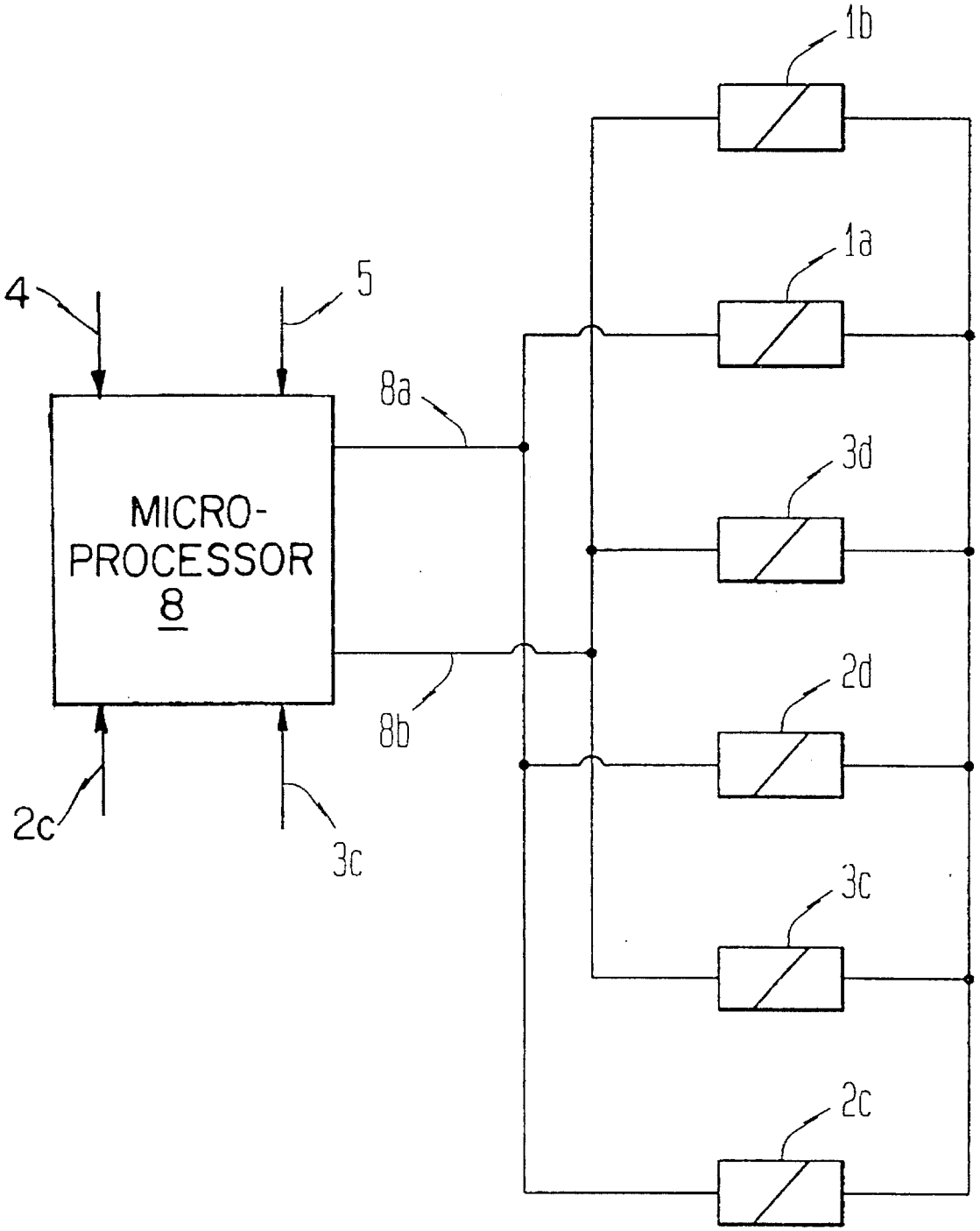
FIG. 2 schematically illustrates a control system for the apparatus of FIG. 1.

FIG. 2 illustrates the previously mentioned control system for the arrangement of FIG. 1. The control system includes a control unit 8, e.g., a microprocessor, which receives signals from the sensors 4, 5 serving to detect the trailing ends of the films exiting the chambers 2, 3. The control unit 8 also receives pulses from the stepping motors which drive the conveying devices 2*c*, 3*c* so that the control unit 8 has data on the lengths of the films passing through the conveying devices 2*c*, 3*c*.

The control unit 8 is connected via a contact 8*a* to the locking mechanism for the cover 1*a* of the chamber 2, the flap 2*d* for the outlet opening of the chamber 2, and the conveying device 2*c* located in the chamber 2. The control unit 8 is further connected by way of a second contact 8*b* to the locking mechanism for the cover 1*b* of the chamber 3, the flap 3*d* for the outlet opening of the chamber 3, and the conveying device 3*c* situated in the chamber 3.

The group of components 1*a*, 2*c*, 2*d* associated with the contact 8*a* and the group of components 1*b*, 3*c*, 3*d* associated with the contact 8*b* are activated alternately by the control unit 8. Referring to FIG. 1 in conjunction with FIG. 2, a film is in the process of being unwound from a cartridge 9 in the chamber 2 while a second cartridge 9 has been inserted in the chamber 3 preparatory to being unloaded. In this condition, the cover 1*a* of the chamber 2 is locked, the flap 2*d* for the outlet opening of the chamber 2 is open and the conveying device 2*c* in the chamber 2 is operative. On the other hand, the cover 1*b* for the chamber 3 is unlocked, the flap 3*d* for the outlet opening of the chamber 3 is closed and the conveying device 3*c* in the chamber 3 is inoperative.

When the sensor 4 detects the trailing end of the film issuing from the chamber 2, the sensor 4 sends a signal to the control unit 8. In response to this signal, the control unit 8 switches the group of components 1*a*, 2*c*, 2*d* as well as the group of components 1*b*, 3*c*, 3*d*. Thus, the flap 2*d* of the chamber 2 is closed, the conveying device 2*c* in the chamber 2 is stopped and the cover 1*a* of the chamber 2 is unlocked. In contrast, the cover 1*b* of the chamber 3 is locked, the flap 3*d* of the chamber 3 is opened and the conveying device 3*c* in the chamber 3 is started.

Generally speaking, the control unit 8 activates the group of components 1*a*, 2*c*, 2*d* while deactivating the group of components 1*b*, 3*c*, 3*d* and deactivates the group of components 1*a*, 2*c*, 2*d* while activating the group of components 1*b*, 3*c*, 3*d*.

The operation of the arrangement of FIGS. 1 and 2 is as follows:

It is assumed, as shown in FIG. 1, that a cartridge 9 has been placed in the chamber 2 and that the film in this cartridge 9 is in the process of being unwound. The film travels through the passage defined by the cutter 2b, between the rollers of the conveying device 2*c* and through the outlet opening of the chamber 2. After passing by the flap 2*d* of the outlet opening, the film travels through the sensor 4 to the junction 6 of the vertical path originating in the chamber 3 and the inclined path originating in the chamber 2. At the junction 6, the film is deflected into the path leading to the film processing apparatus 7.

In the position illustrated in FIG. 1, the leader card 10 attached to the leading end of the film has just reached the entrance to the film developing apparatus 7. By continuing to advance the leader card 10 and the film into the film developing apparatus 7, the film is continuously developed while being continuously withdrawn from the cartridge 9 in the chamber 2.

Due to the fact that the group of components 1*b*, 3*c*, 3*d* is deactivated when the group of components 1*a*, 2*c*, 2*d* is activated, the cover 1*b* of the chamber 3 is unlocked. This condition can be visually indicated, for instance, by a green indicator light 32 located in the region of the cover 1*b*. Furthermore, the conveying device 3*c* in the chamber 3 is at a standstill and the flap 3*d* for the outlet opening of the chamber 3 is closed. Under these circumstances, an operator can open the cover 1*b* of the chamber 3 and insert a cartridge 9 together with a leader card 10 which is attached to the leading end of the film in the cartridge 9. The operator advances the leader card 10 through the passage in the cutter 3*b* and between the rollers of the conveying device 3*c*. The operator thereupon closes the cover 1*b*.

When the film being withdrawn from the chamber 2 has been completely unwound from its cartridge 9, the tension in the film increases significantly. The increase in tension is detected by the sensor 21, and the sensor 21 sends a signal to the cutter 2*b* which cuts the film.

The cut, trailing end of the film leaves the chamber 2 and passes by the sensor 4 which detects the trailing end and sends a signal to the control unit 8 indicating that withdrawal of the film from the chamber 2 is finished. The control unit 8, in turn, deactivates the group of components 1*a*, 2*c*, 2*d* and activates the group of components 1*b*, 3*c*, 3*d*. Consequently, the flap 2*d* of the chamber 2 is closed, the conveying device 2*c* in the chamber 2 is stopped and the cover 1*a* of the chamber 2 is unlocked. At the same time, the cover 1*b* of the chamber 3 is locked, the flap 3*d* of the chamber 3 is opened and the conveying device 3*c* in the chamber 3 is started. The leader card 10 in the chamber 3 is thereupon conveyed out of the chamber 3 and past the sensor 5 to the junction 6 where it enters the same path as the film previously withdrawn from the chamber 2. By programming the control unit 8 with the time delay for switching from one group of components 1*a*, 2*c*, 2*d* or 1*b*, 3*c*, 3*d* to the other and with the difference in distance between the junction 6 and the outlet openings of the chambers 2 and 3, the control unit 8 can establish the smallest possible spacing between the leading end of the film from the chamber 3 and the trailing end of the film from the chamber 2.

Since the group of components 1*a*, 2*c*, 2*d* was deactivated, the cover 1*a* of the chamber 2 is unlocked. This condition can be visually indicated, for example, by a green indicator light 22 disposed in the vicinity of the cover 1*a*. The green light advises the operator to remove the empty cartridge 9 from the chamber 2 and to insert a new cartridge 9 with leader card 10. Hence, when the film being unwound from the cartridge 9 in the chamber 3 has been withdrawn from the chamber 3 completely and switching of the groups of components 1*a*, 2*c*, 2*d* and 1*b*, 3*c*, 3*d* has occurred, feeding of a new film can proceed immediately from the chamber 2.

The output of the film developing apparatus 7 is greater than that of a copying apparatus. Accordingly, if the film developing apparatus 7 is integrated into a single unit with a copying machine, a situation can arise in which a film is in a holding position upstream of the copying station thereby preventing entry of a new film into the developing area. This information can be delivered to the control unit 8 via a suitable sensor. The control unit 8 can then delay the switch from one group of components 1*a*, 2*c*, 2*d* or 1*b*, 3*c*, 3*d* to the other until sufficient space for the new film is available upstream of the copying station.

By designing the housing 1 appropriately, it is possible, in principle, to provide a third unloading chamber.

Various modifications can be made within the meaning and range of equivalence of the appended claims.

What is claimed is:

1. An apparatus for processing image-recording media confined in substantially lightproof containers, comprising first wall means defining a first substantially lightproof chamber for unloading the containers; second wall means defining a second substantially lightproof chamber for unloading the containers; first conveying means for conveying image-recording media from said first chamber along a first path having an upstream portion in said first chamber; and second conveying means for conveying image-recording media from said second chamber along a second path having an upstream portion in said second chamber, said paths having a junction and merging into a third path downstream of said chambers.

2. The apparatus of claim 1, further comprising control means arranged to activate said first conveying means while deactivating said second conveying means and to activate said second conveying means while deactivating said first conveying means.

3. The apparatus of claim 2, wherein said control means is designed to activate said first conveying means and said second conveying means alternately when said first chamber and said second chamber are alternately supplied with containers.

4. The apparatus of claim 3, wherein said control means is designed to activate and deactivate said first conveying means and said second conveying means in such a manner as to permit image-recording media from said first and second paths to enter said third path substantially without interruption.

5. The apparatus of claim 1, wherein said first chamber has a first openable and closable inlet for containers and said second chamber has a second openable and closable inlet for containers; and further comprising control means arranged to permit opening of said first chamber and said second chamber alternately when said first chamber and said second chamber are alternately supplied with containers.

6. The apparatus of claim 1, wherein said chambers are substantially identical.

7. The apparatus of claim 1, further comprising means along said third path for developing the image-recording media.

8. The apparatus of claim 1, further comprising leaders for attachment to the leading ends of the image-recording media, said conveying means and said junction being dimensionally matched to said leaders.

9. The apparatus of claim 1, wherein each of said chambers has an openable and closable inlet for the containers and an openable and closable outlet for the image-recording media unloaded from the containers; and further comprising control means arranged to permit opening of the outlet of each chamber only when the inlet is closed and to permit opening of the inlet of each chamber only when the outlet is closed.

10. The apparatus of claim 9, wherein said control means is arranged to activate the conveying means for each of said chambers upon opening of the outlet of the respective chamber.

11. The apparatus of claim 9, wherein said inlets are openable manually; and further comprising locking devices for said inlets.

12. The apparatus of claim 9, wherein said inlets are openable manually; and further comprising status indicating devices in the regions of said inlets.

13. The apparatus of claim 1, wherein each of said chambers has an openable and closable inlet for the containers and an openable and closable outlet for the image-recording media unloaded from the containers; and further comprising a sensing element along each of said first and second paths for sensing the trailing ends of the image-recording media, and control means for regulating said inlets, outlets and conveying means in response to signals from said sensing elements.

14. The apparatus of claim 13, wherein each of said sensing elements is located between the respective chamber and said junction.

15. The apparatus of claim 1, further comprising first sensing means for sensing the tension in image-recording media which are unloaded from containers in said first chamber, and second sensing means for sensing the tension in image-recording media which are unloaded from containers in said second chamber.

16. The apparatus of claim 15, wherein said first sensing means is located in said first chamber and said second sensing means is located in said second chamber.

17. The apparatus of claim 15, further comprising first severing means for severing image-recording media in response to signals from said first sensing means, and second severing means for severing image-recording media in response to signals from said second sensing means.

18. A method of processing image-recording media confined in substantially lightproof containers, comprising the steps of placing a first container with a first image-recording medium in a first chamber; withdrawing said first image-recording medium from said first container; conveying said first image-recording medium out of said first chamber along a first path; transferring said first image-recording medium from said first path into an additional path at a predetermined location; placing a second container with a second image-recording medium in a second chamber; withdrawing said second image-recording medium from said second container; conveying said second image-recording medium out of said second chamber along a second path; and transferring said second image-recording medium from said second path into said additional path at said predetermined location, the step of transferring said second image-recording medium being performed subsequent to the step of transferring said first image-recording medium.

19. The method of claim 18, wherein said first image-recording medium has a trailing end and said second image-recording medium has a leading end, the step of transferring said second image-recording medium being carried out in such a manner that said leading end of said second image-recording medium is adjacent said trailing end of said first image-recording medium.

20. The method of claim 18, wherein the step of placing said second container is performed concurrently with the step of withdrawing said first image-recording medium.

21. The method of claim 18, further comprising the steps of removing said first container from said first chamber subsequent to the step of withdrawing said first image-recording medium; placing a third container with a third image-recording medium in said first chamber; withdrawing said third image-recording medium from said third container; conveying said third image-recording medium out of said first chamber along said first path; and transferring said third image-recording medium from said first path into said additional path at said predetermined location, the step of transferring said third image-recording medium being performed subsequent to the step of transferring said second image-recording medium.

22. The method of claim 21, wherein the steps of removing said first container and placing said third container are performed concurrently with the step of withdrawing said second image-recording medium.

23. The method of claim 18, wherein each of the placing steps comprises opening a first portion of the respective chamber and each of the conveying steps comprises opening a second portion of the respective chamber; and further comprising the steps of preventing opening of the first portion of each chamber when the corresponding second portion is open, and keeping the second portion of each chamber closed when the corresponding first portion is open.

24. The method of claim 23, wherein the withdrawing and conveying steps for each of said chambers are initiated upon opening of the second portion of the respective chamber.

25. The method of claim 23, wherein each of said first and second image-recording media has a trailing end; and further comprising the steps of detecting said trailing ends of said first and second image-recording media in the respective paths, generating a signal in response to detection of each trailing end, and regulating the second portion of each chamber, as well as the withdrawing and conveying steps for the respective chamber, using the respective signal.

26. The method of claim 18, further comprising the steps of sensing the tension of said first image-recording medium during the respective withdrawing and conveying steps, and sensing the tension of said second image-recording medium during the respective withdrawing and conveying steps.

27. The method of claim 26, further comprising the steps of severing said first image-recording medium in response to sensing of a predetermined tension in said first image-recording medium, and severing said second image-recording medium in response to sensing of a predetermined tension in said second image-recording medium.

* * * * *